US006021771A

United States Patent [19]

Swan et al.

[11] Patent Number: 6,021,771

[45] Date of Patent: Feb. 8, 2000

[54] SURFACING MACHINE WITH "STRIP-SERT" CUTTER ASSEMBLIES

[75] Inventors: Leo Swan, Jefferson; William Richard Harding, Federick, both of Md.

[73] Assignee: Equipment Development Co., Inc., Frederick, Md.

[21] Appl. No.: 09/148,335

[22] Filed: Sep. 4, 1998

[51] Int. Cl.[7] ..... B28D 1/18

[52] U.S. Cl. ..... 125/5; 451/485; 451/342; 299/109; 299/41.1; 82/163

[58] Field of Search ..... 125/11.19, 28, 125/3, 5; 451/357, 359, 352, 342, 485, 486; 299/107, 109, 41.1, 108; 407/35, 53; 82/112, 163

[56] References Cited

U.S. PATENT DOCUMENTS

| | | | |
|---|---|---|---|
| 2,099,207 | 11/1937 | Hill et al. | 451/485 |
| 2,340,018 | 1/1944 | Rickrode | 451/485 |
| 4,643,188 | 2/1987 | Persson | 125/5 |
| 4,758,050 | 7/1988 | Peterson et al. | 299/41.1 |
| 5,335,977 | 8/1994 | Morrell et al. | 299/107 |
| 5,409,299 | 4/1995 | Holder | 299/41.1 |
| 5,683,143 | 11/1997 | Peterson et al. | 299/41.1 |

*Primary Examiner*—Robert A. Rose
*Assistant Examiner*—George Nguyen

[57] ABSTRACT

A cutter assembly for installation on the rotary discs of a concrete finishing/stripper machine includes a base member for mounting on the rotary disc of a machine, a cutter member carried on the base member having a plurality of interchangeable cutting edges selectively presentable to a cutting position, a guide channel for constraining the cutter element for movement relative to the base member between first and second positions, and a coil spring for urging the cutter member toward a first of the positions while permitting movement of the cutter element along a path away from the first position and toward a deflected position in response to forces applied to the cutter element caused by obstructions on the surface being finished. The compression or pre-load on the coil spring is adjustable for varying conditions. The entire cutter assembly is readily mountable onto the bottom of the rotating disc and channels thereof by wedges, making set up of the machine quick and easy.

37 Claims, 3 Drawing Sheets

SURFACING MACHINE WITH "STRIP-SERT" CUTTER ASSEMBLIES

BACKGROUND OF THE INVENTION

The present invention relates to a cutter head assembly for use on the rotary discs of concrete surfacing/stripping machines. More specifically, the present invention relates to cutter assemblies which are readily and quickly attachable and detachable from the rotary discs, and including spring biased cutter blades for accommodating shocks from obstructions encountered on the work surface being finished or stripped.

Heretofore, various types of concrete finisher/strippers have been designed with a variety of types of replaceable cutter assemblies. Some of these machines have been designed with the primary goal of achieving a cutter assembly which may be quickly and easily replaceable on the rotary discs. Some have been designed to minimize shock from obstructions encountered on the concrete surfaces being finished. Others have been designed to provide for easy substitution of sharpened cutting edges from multi-edge cutting blades.

However, a need in the art exists for cutter assemblies for concrete finisher/strippers which achieves all of these above goals in combination.

SUMMARY OF THE INVENTION

Accordingly, it is a primary object of the present invention to provide a cutter assembly for concrete finisher/strippers which provides in combination quick and easy attachment to the rotary discs; absorption of shock from obstructions on the concrete surface; and easy rotation or substitution of fresh cutting edges from the multi-edge blades.

It is another object of the present invention to provide a cutter head assembly wherein the shock absorption capabilities of the assembly are adjustable.

It is still another object of the present invention to provide a cutter head assembly wherein the assemblies may be attached to the bottom of the rotary discs of the machines without the use of screws or bolts.

It is a further object of the present invention to provide a cutter head assembly for concrete finisher/stripper machines which absorb shock from forces parallel to the surfaces of the rotating discs thereof.

The objects of the present invention are fulfilled by providing a cutter head assembly for use in a concrete finisher/stripper comprising:

a support member adapted for rotation about an axis;

at least one cutter member carried on the support member for orbital movement about the axis of rotation in a plane which is generally perpendicular to the axis of rotation, the cutter member including a cutting edge disposed in a cutting position generally parallel to the plane of orbital movement;

guide means for constraining the cutter for movement relative to the support member between a first position and deflected position along a path which is spaced from the axis of rotation, the first position leading the deflected position in the direction of orbital movement of the cutter element; and biasing means for urging the cutter member toward the first position while permitting movement of the cutter element along the path away from the first position and toward the deflected position in response to a force applied to the cutter member in a direction which is opposed to the direction of orbital movement of the cutter element.

The cutter head assembly also includes an adjustment means for varying the magnitude of the force by which the biasing means urges the cutter member toward the first position. The biasing means in a preferred embodiment comprises a compression spring, and the adjustment means comprises a threaded assembly for varying a pre-load applied to the spring.

The cutter element of the cutter head assembly includes a plurality of cutting edges, and the mounting means permits mounting of the cutting element on a support block of the assembly so that any one of the cutting edges is disposed selectively in the cutting position while the other cutting edges are disposed in non-cutting positions. Thus, the cutting edges may be changed without removing the entire cutting head assembly from its associated rotary disc.

BRIEF DESCRIPTION OF THE DRAWINGS

The features of the present invention and the attendant advantages thereof will become more readily apparent with reference to the drawings wherein.

DETAILED DESCRIPTION OF PREFERRED EMBODIMENTS

Figure 1:
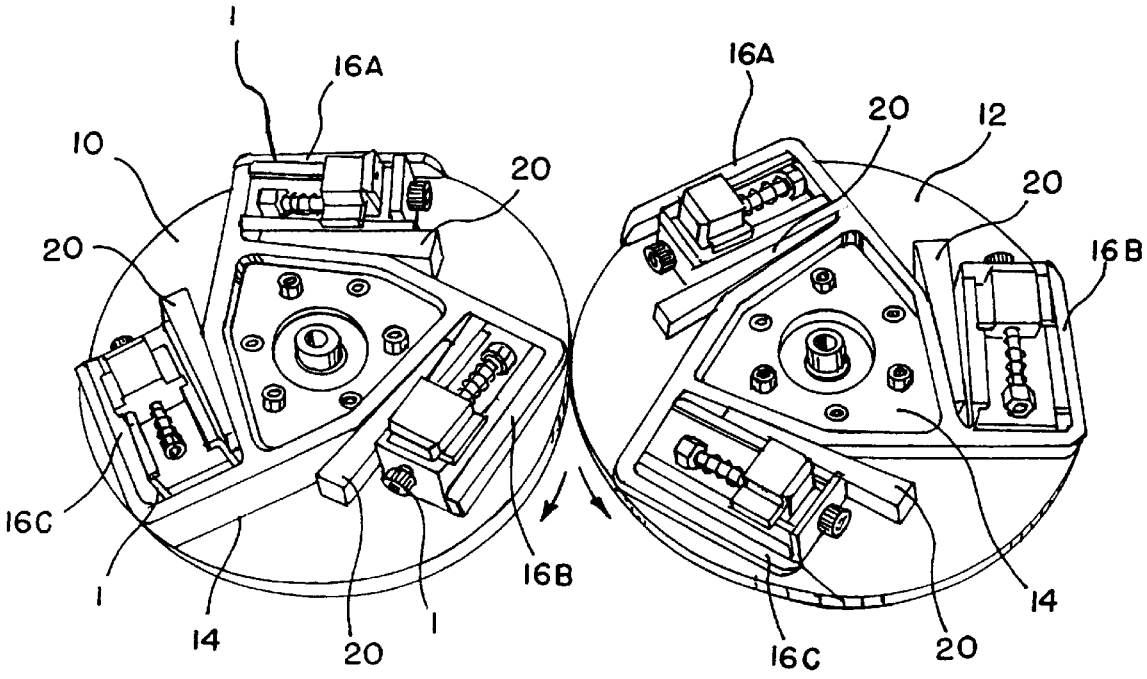
FIG. 1 illustrates a plurality of cutter assemblies of the present invention mounted on the bottom surfaces of a pair of rotary discs of a concrete stripper/finisher.

Referring to FIG. 1 there is illustrated a pair of rotary discs 10 and 12 to be mounted on the bottom of a floor finishing machine by securing the same to a pair of motor-powered rotors of the unit. The floor finishing machine may be powered by either an electric motor or gasoline motor. It may be a portable unit with a handle manipulated by the operator's hands, or it may be of the riding-type well known in the art. As is conventional, the rotary discs 10 and 12 are rotatable in opposite directions as indicated by the directional arrows in FIG. 1.

Each of the discs includes a configuration of partitions on the bottom thereof defining a substantially triangular hub portion 14 with an aperture in the center for accommodating the rotors of the finishing machine, and a plurality of holes for bolting the discs to the rotors. Surrounding the triangular hub portions are a plurality of symmetrically disposed rectangular channels 16A, 16B, and 16C. These rectangular channels are formed by L-shaped extensions of the partitions defining the triangular hubs at each of the apices. The rectangular channels have open ends which are leading ends in the direction of rotation of the respective discs. Each of these rectangular channels are provided to accommodate one of the cutter assemblies 1 of the present invention with the leading ends 1A of the cutter assemblies disposed in the open end of the rectangular channels and the trailing ends 1B seated against the end wall of the rectangular channels. The cutter assemblies 1 are removably secured within the rectangular channels by means of wedges 20 which may be wood, plastic or any other suitable material.

Figure 2:
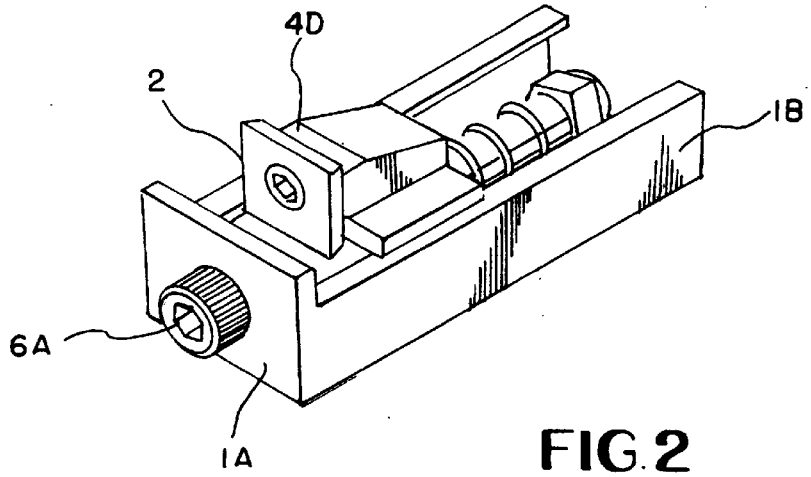
FIG. 2 is a perspective view of one of the cutter assemblies illustrated in FIG. 1 removed from the rotary disc.
Figure 3:
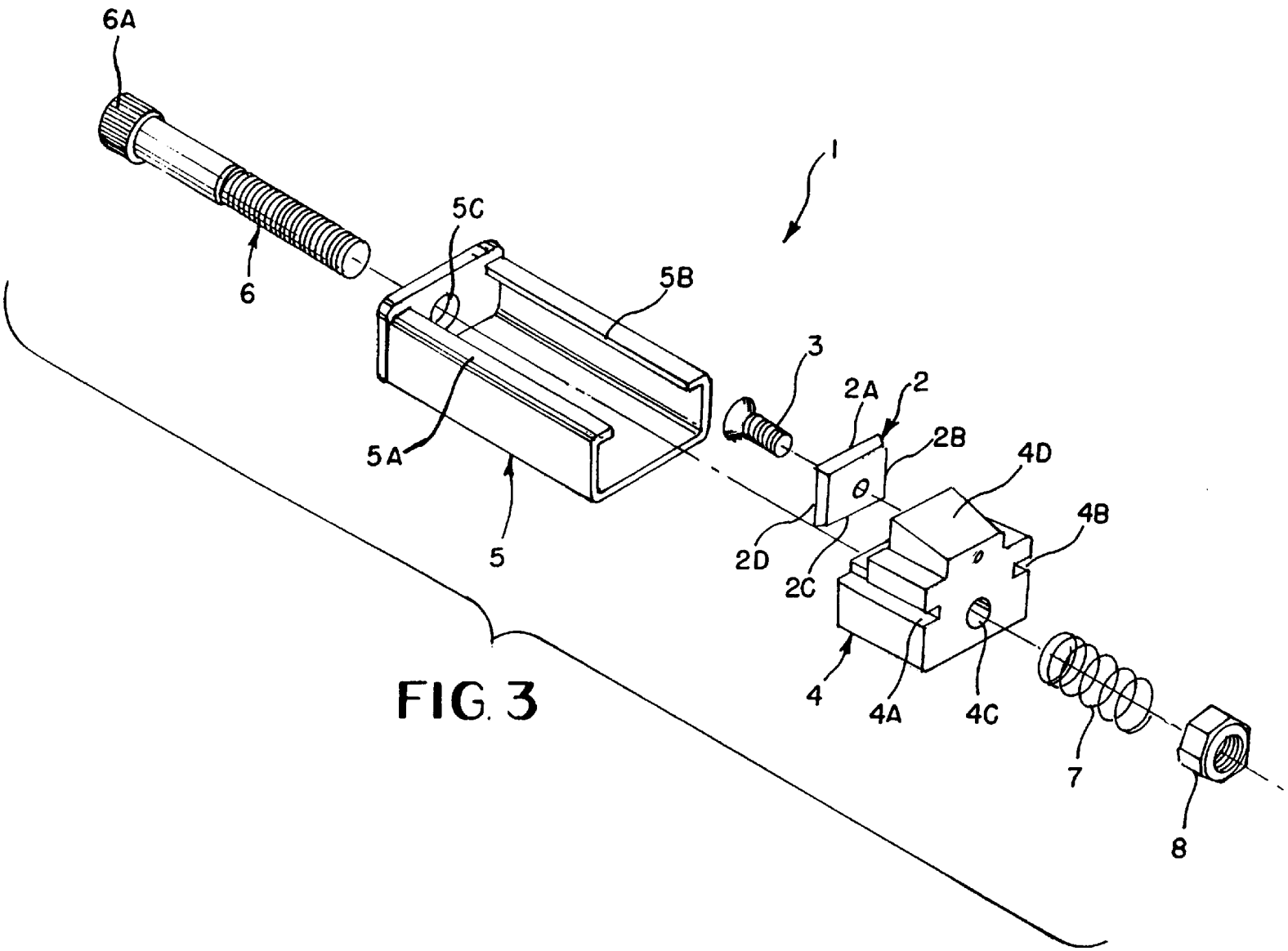
FIG. 3 is an exploded view of one of the cutter assemblies of FIG. 2.

Further details of the cutter assemblies 1 are illustrated in FIGS. 2 and 3. FIG. 2 illustrates the cutter assembly in a fully assembled condition suitable for connection to the rotary discs 10 and 12 as illustrated in FIG. 1. FIG. 3 is an exploded view showing each of the cooperating parts of the cutter assembly 1.

As depicted in FIGS. 2 and 3, the cutter assembly 1 includes a channel 5 with inwardly directed flanges 5A and 5B along the top edges thereof and an aperture 5C for accommodating an adjustment screw or bolt 6 therethrough. Channel 5 has an open end for receiving a cutter holding block 4. Cutter block 4 includes a pair of side grooves 4A and 4B for receiving the flanges 5A and 5B, respectively of the channel 5 when the block 4 is disposed in sliding engagement with channel 5. Block 4 also has an upstanding top protrusion 4D which has a sloped top surface ceiling and a perpendicular face for receiving a removable cutter 2 thereon by means of an attaching screw 3.

The cutter element 2 has four cutting edges 2A, 2B, 2C, 2D so that the edges may be readily changed to present the sharpest edge to the cutting position, namely, the top of the cutter element as illustrated in FIG. 2. That is, the cutting edge may be easily changed by removing screw 3 and rotating the cutting element to present the sharpest of the edges to the top of the cutting element (the bottom of the element when resting on the surface being finished).

Figure 4:
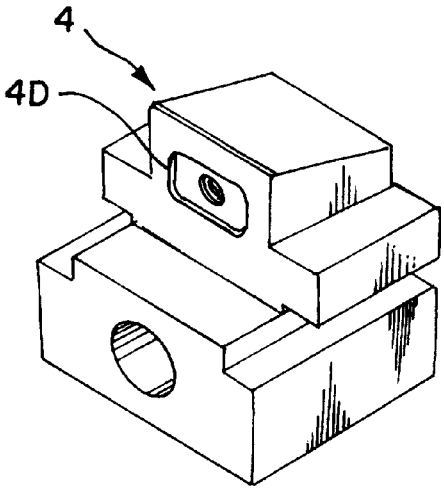
FIG. 4 is a perspective view illustrating a preferred embodiment of the cutter block for maintaining the cutter edge square to the surface being finished irrespective of wear to the cutter edge.
Figure 5:
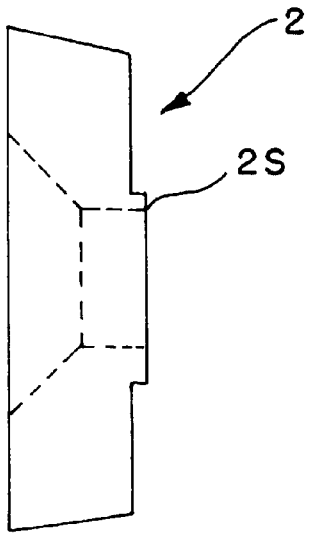
FIG. 5 is a side elevational view of a cutter blade for use with the cutter block of FIG. 4.

Blade 2 is fabricated, in a preferred embodiment of FIGS. 4 and 5 with a raised, substantially square, shoulder 25 on the back side thereof. Shoulder 25 fits into a complementary shaped depression 4D, in block 4. Depression 4D can be milled to fit the size of shoulder 25 or may be a milled slot extending across the entire face of block 4.

The purpose of the depression or slot 4D is to hold the carbide tool square to the floor surface even when the cutting edge in use is worn and uneven.

Block 4 also includes a bore 4C for receiving bolt 6 therethrough such that the threaded end of the bolt 6 extends to enable coil spring 7 to be placed thereon and secured by a retaining nut 8. Coil spring 7 provides a means for absorbing shocks from obstructions engaged by cutting element 2 during the rotation of the rotary disc 10,12. It can be seen that the compression or pre-load on this coil spring may be varied by tightening or loosening bolt 6 with an appropriate hand tool inserted into socket 6A. It can be seen from FIGS. 2 and 3 that when the cutter assembly is fully assembled as illustrated in FIG. 2, that the hexagonal nut 8 engages the bottom or floor of channel 5 precluding rotation of nut 8 so that when bolt 6 is rotated it will tighten or loosen nut 8. This will of course vary the compression of spring 7 and, therefore, the pre-load strength of the spring 7.

Thus, it can be seen by reference to FIG. 1 that as the respective discs 10,12 rotate in the directions indicated, the cutter element 2 will scrape or strip the floor on which they rest. And, if an obstruction such as a hardened lump of glue or concrete is encountered by the cutting edge of element 2 during rotation, the element 2 is able to back off along the linear path extending along bolt 6 and within channel 5 in order to avoid or at least absorb the shock from the lump or obstruction. This enables the stripping process to proceed with less vibration and noise and with less potential damage to the cutting elements.

In operation, the concrete stripper is assembled for operation by selecting a fresh cutter 2 for the cutter assembly 1 and securing it by screw 3 to the vertical face of block 4. The adjustment screw 6A is then manipulated by a hand tool inserted into socket 6A to select the proper pre-load for coil spring 7 depending on the type of surface being finished. This is done for each of the six cutter assemblies for the finisher configuration illustrated in FIG. 1 of the present invention having two rotary discs. Each of the cutter assemblies 1 are inserted into the rectangular channels 16A, 16B, 16C, 16D on each of the rotary discs 11 and 12. A plurality of wedges 20 are then used to rapidly and easily secure the cutter assemblies within the rectangular channels. The stripper machine is then ready for operation. Periodically, as the cutting edges of cutter element 2 become worn, they are selectively removed and rotated to provide a fresh cutting edge to the cutting position by simply removing and replacing screw 3. The compression on spring 7 may also be varied from time to time if a different pre-load works better for the surface being finished.

While presently preferred embodiments of the present invention have been illustrated and described, modifications and variations thereof will be apparent to those skilled in the art given the teachings herein, and it is intended that all such modifications and variations be encompassed within the scope of the appended claims.

What is claimed is:

1. A cutter head assembly for use in a rotary apparatus for removing surface material from a substrate, comprising:

a support member adapted for rotation about an axis;

at least one cutter member carried on the support member for orbital movement about the axis of rotation in a plane which is generally perpendicular to the axis of rotation, the cutter member including a cutting edge disposed in a cutting position generally parallel to the plane of orbital movement;

guide means for constraining the cutter member or movement relative to the support member between a first position and a deflected position along a path which is spaced from the axis of rotation, the first position leading the deflected position in the direction of orbital movement of the cutter element; and biasing means for urging the cutter member toward the first position while permitting movement of the cutter element along the path away from the first position and toward the deflected position in response to a force applied to the cutter member in a direction which is opposed to the direction of orbital movement of the cutter element.

2. The cutter head assembly as recited in claim 1, wherein the path is generally linear.

3. The cutter head assembly as recited in claim 1, and further comprising adjustment means for varying the magnitude of the force by which the biasing means urges the cutter member toward the first position.

4. The cutter head assembly as recited in claim 3, wherein the biasing means comprises a compression spring, and the adjustment means comprises a threaded assembly for varying a pre-load applied to the spring.

5. The cutter head assembly as recited in claim 1, wherein the guide means comprises a base member carried on the support member at a location which is spaced from the axis of rotation, the base member including an abutment surface which defines the first position.

6. The cutter head assembly as recited in claim 5, wherein the biasing means resiliently urges the cutter member against the abutment surface.

7. The cutter head assembly as recited in claim 6, and further comprising adjustment means for varying the magnitude of the force by which the biasing means urges the cutter member against the abutment surface.

8. The cutter head assembly as recited in claim 7, wherein the biasing means comprises a compression spring, and the adjustment means comprises a threaded assembly for varying a pre-load applied to the spring.

9. The cutter head assembly as recited in claim 5, wherein the base member comprises a channel, and the cutter member is mounted within the channel for movement relative to the support member along the path.

10. The cutter head assembly as recited in claim 9, wherein the abutment surface comprises a wall extending transversely to the path across an end of the channel.

11. The cutter head assembly as recited in claim 9, wherein the cutter member further comprises:

a support block mounted for sliding movement within the channel;

a separate cutter element having the cutting edge; and mounting means for mounting the cutter element on the support block.

12. The cutter head assembly as recited in claim 11, wherein the cutter element includes a plurality of cutting edges, and the mounting means permits mounting of the cutter element on the support block so that any one of the cutting edges is disposed in the cutting position while the other cutting edges are disposed in non-cutting positions.

13. The cutter head assembly as recited in claim 12, wherein the cutter element includes four cutting edges which are arranged to form a square.

14. The cutter head assembly as recited in claim 5, wherein:

the support member includes a generally planar surface disposed generally perpendicularly to the axis of rotation and walls projecting from the planar surface which form at least one recess; and the base member is disposed in the recess.

15. The cutter head assembly as recited in claim 14, wherein:

an outer end of the recess opens through a peripheral edge of the support member;

a wall projecting from the planar surface forms a closed inner end of the channel; and an end of the base member abuts the wall forming the inner end of the recess.

16. The cutter head assembly as recited in claim 15, wherein:

the support member includes a plurality of the recesses arranged equiangularly about the axis of rotation; and a base member is disposed in each of the recesses.

17. A cutter assembly for installation on a rotary support member of an apparatus for removing surface material from a substrate, the cutter assembly comprising:

a base member adapted for mounting on the rotary support member;

a cutter member carried on the base member, the cutter member comprising a cutting edge disposed in a cutting position;

guide means for constraining the cutter element for movement relative to the base member between a first position adjacent a first end of the base member and a deflected position along a path extending between the first end and a second end of the base member; and biasing means for urging the cutter member toward the first position while permitting movement of the cutter element along the path away from the first position and toward a deflected position in response to a force applied to the cutter element in a direction from the first end to the second end of the base member.

18. The cutter assembly as recited in claim 17, wherein the path is generally linear.

19. The cutter assembly as recited in claim 17, and further comprising adjustment means for varying the magnitude of the force by which the biasing means urges the cutter member toward the first position.

20. The cutter assembly as recited in claim 19, wherein the biasing means comprises a compression spring, and the adjustment means comprises a threaded assembly for varying a pre-load applied to the spring.

21. The cutter assembly as recited in claim 17, wherein:

the base member comprises a channel having a bottom wall, transversely spaced sidewalls, and an abutment surface which defines the first position; and the guide means comprise the sidewalls of the channel.

22. The cutter assembly as recited in claim 21, wherein the abutment surface comprises a wall extending transversely to the path across an end of the channel.

23. The cutter assembly as recited in claim 22, wherein the biasing means resiliently urges the cutter element against the abutment surface.

24. The cutter assembly as recited in claim 23, wherein the biasing means resiliently urges the cutter member against the abutment surface.

25. The cutter assembly as recited in claim 24, wherein the biasing means comprises a compression spring, and the adjustment means comprises a threaded assembly for varying a pre-load applied to the spring.

26. The cutter assembly as recited in claim 21, wherein the cutter member further comprises:

a support block mounted for sliding movement within the channel;

a separate cutter element provided with the cutting edge; and mounting means for mounting the cutter element on the support block.

27. The cutter assembly as recited in claim 26, wherein the cutter element includes a plurality of cutting edges, and the mounting means permits mounting of the cutter element on the support block so that any one of the cutting edges is disposed in a cutting position while the other cutting edges are disposed in non-cutting positions.

28. The cutter assembly as recited in claim 27, wherein the cutter element includes four cutting edges which are arranged to form a square.

29. The cutter head assembly as recited in claim 28 wherein the support block includes a cutter mounting surface facing an opposed surface of the cutter element, one of the cutter mounting surface or opposed surface having a protrusion of a predetermined shape, the other of the surface having a recess for receiving the protrusion in a closely fitting relationship which holds the cutter element square to the surface being finished regardless of the condition of the cutting edge of the cutter element.

30. The cutter head assembly as recited in claim 29 wherein the recess is a depression shaped to conform to the protrusion.

31. The cutter head assembly of claim 29 wherein the recess is a slot extending across the cutter mounting surface on the cutter element.

32. The cutter head assembly as recited in claim 26 wherein the support block includes a cutter mounting surface facing an opposed surface of the cutter element, one of the cutter mounting surface or opposed surface having a protrusion of a predetermined shape, the other of the surface having a recess for receiving the protrusion in a closely fitting relationship which holds the cutter element square to the surface being finished regardless of the condition of the cutting edge of the cutter element.

33. The cutter head assembly as recited in claim 13 wherein the support block includes a cutter mounting surface facing an opposed surface of the cutter element, one of the cutter mounting surface or opposed surface having a protrusion of a predetermined shape, the other of the surface having a recess for receiving the protrusion in a closely fitting relationship which holds the cutter element square to the surface being finished regardless of the condition of the cutting edge of the cutter element.

34. The cutter head assembly as recited in claim 12 wherein the support block includes a cutter mounting surface facing an opposed surface of the cutter element, one of the cutter mounting surface or opposed surface having a protrusion of a predetermined shape, the other of the surface having a recess for receiving the protrusion in a closely fitting relationship which holds the cutter element square to the surface being finished regardless of the condition of the cutting edge of the cutter element.

35. The cutter head assembly as recited in claim 11 wherein the support block includes a cutter mounting surface facing an opposed surface of the cutter element, one of the cutter mounting surface or opposed surface having a protrusion of a predetermined shape, the other of the surface having a recess for receiving the protrusion in a closely fitting relationship which holds the cutter element square to the surface being finished regardless of the condition of the cutting edge of the cutter element.

36. The cutter head assembly as recited in claim 35 wherein the recess is a depression shaped to conform to the protrusion.

37. The cutter head assembly of claim 35 wherein the recess is a slot extending across the cutter mounting surface on the cutter element.

* * * * *